US011054789B2

(12) United States Patent
Sakamoto et al.

(10) Patent No.: US 11,054,789 B2
(45) Date of Patent: Jul. 6, 2021

(54) IMAGE FORMING APPARATUS PROVIDED WITH A DUCT

(71) Applicant: SHARP KABUSHIKI KAISHA, Sakai (JP)

(72) Inventors: Masafumi Sakamoto, Sakai (JP); Hideaki Kadowaki, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 16/231,408

(22) Filed: Dec. 22, 2018

(65) Prior Publication Data

US 2019/0196397 A1 Jun. 27, 2019

(30) Foreign Application Priority Data

Dec. 27, 2017 (JP) ..... JP2017-250778

(51) Int. Cl.
*G03G 21/20* (2006.01)
*G03G 15/20* (2006.01)

(52) U.S. Cl.
CPC ..... *G03G 21/206* (2013.01); *G03G 15/2017* (2013.01); *G03G 2221/1645* (2013.01)

(58) Field of Classification Search
CPC ..... G03G 21/206; G03G 15/6555; G03G 15/6573; G03G 15/6579; G03G 2221/1645; G02G 2221/1645
See application file for complete search history.

(56) References Cited

U.S. PATENT DOCUMENTS 6,356,722 B1 * 3/2002 Kida ..... H04N 1/00519 399/92
7,020,411 B2 * 3/2006 Awaya ..... G03G 15/6573 399/92
7,315,721 B2 * 1/2008 Kitayama ..... B65H 29/58 399/320
8,218,996 B2 * 7/2012 Shimizu ..... G03G 15/6573 399/92
9,541,895 B1 * 1/2017 Kuroda ..... G03G 15/6573
(Continued)

FOREIGN PATENT DOCUMENTS

JP 11024352 A * 1/1999
JP 2014-026196 A 2/2014

OTHER PUBLICATIONS

Machine translation of JP-11024352-A (Year: 1999).*

*Primary Examiner* — Arlene Heredia
(74) *Attorney, Agent, or Firm* — ScienBiziP, P.C.

(57) ABSTRACT

An image forming apparatus includes an apparatus body and an exhaust unit. The exhaust unit includes a first duct and a separating member. The first duct includes a first duct A forming member and a first duct B forming member provided with a plurality of communication ports which form one side surface of a second sheet transport path through which a sheet after heating and fixing is transported, a first exhaust fan for discharging air of the first duct to an outside of the apparatus body, and a filter disposed on a downstream side from the second sheet transport path. The first duct separates the second sheet transport path from spaces other than the first duct in the apparatus body. Further, the separating member separates the second sheet transport path from spaces other than the first duct in the image forming apparatus.

8 Claims, 10 Drawing Sheets

(56) References Cited

U.S. PATENT DOCUMENTS

| | | | | |
|---|---|---|---|---|
| 10,261,468 | B2 * | 4/2019 | Kuroda | G03G 15/2017 |
| 10,401,790 | B2 * | 9/2019 | Wakimoto | G03G 21/206 |
| 2012/0114346 | A1 * | 5/2012 | Kurotsu | G03G 15/2042 399/45 |

* cited by examiner

IMAGE FORMING APPARATUS PROVIDED WITH A DUCT

BACKGROUND

1. Field

The present disclosure relates to an image forming apparatus, and particularly relates to, for example, an image forming apparatus provided with a duct for discharging air inside an apparatus body to the outside of the apparatus body.

2. Description of the Related Art

Japanese Unexamined Patent Application Publication No. 2014-26196 discloses an example of the image forming apparatus in the related art. The image forming apparatus in the related art is provided with a first roller and a second roller which are provided on the downstream side in a sheet transport direction by a fixing device, a first roller heat radiating chamber provided to surround the first roller and is on the side of the first roller opposite to the second roller, and a duct which connects the first roller heat radiating chamber and the outside of the image forming apparatus. A filter and an exhaust fan are provided in the duct, and the air around the first roller is suctioned into the duct from the first roller radiating chamber and is exhausted to the outside of the image forming apparatus by the exhaust fan.

In recent years, regulations on a discharge amount of fine particles, which are referred to as ultrafine particle (UFP) having a particle diameter of 0.1 μm or less, and generated by heating a sheet or toner in a fixing unit of an image forming apparatus, to the outside of the image forming apparatus have been strengthened, and thus countermeasures thereof have been demanded. In order to reduce the amount of UFP discharged to the outside of the image forming apparatus, it is demanded to efficiently collect the UFP so as not to make the UFP discharged to the outside of the image forming apparatus.

However, in the image forming apparatus of the related art, it is intended to cool a sheet that has passed through the fixing device. Specifically, a pair of rollers disposed on the downstream side of the fixing device is externally suctioned from the opening on the downstream side in the sheet transport direction so that the air is sent to cool the roller pair, and the cooled air is suctioned into a duct portion to be discharged outside the apparatus. A filter is installed in the duct portion, but no specification of this filter is given at all.

In the image forming apparatus in the related art, a filter for UFP collection is assumed to be employed as the filter of the duct portion. In this case, the filter for UFP collection has very fine mashes of the filter in order to collect fine particles having a particle diameter of 0.1 μm or less, so that the air is difficult to pass and airflow resistance is very large, and the amount of air passing through the filter to flow is decreased. At this time, there is a concern in that the pair of rollers may be insufficiently cooled.

Further, since the image forming apparatus in the related art is not configured to suction the air in the space where the sheet transport path on the downstream side by the fixing device is installed, there is a concern in that the UFPs generated in the downstream space of the fixing device and are discharged to the outside without being efficiently collected.

It is desirable to provide a new image forming apparatus.

It is also desirable to provide an image forming apparatus capable of capturing substances such as UFPs generated in the image forming apparatus without missing and restraining emission to the outside of the apparatus. More specifically, it is desirable to provide an image forming apparatus capable of restraining the temperature inside the image forming apparatus from rising, capable of restraining the discharge of substances such as UFPs to the outside of the apparatus and restraining temperature rise in the image forming apparatus.

SUMMARY

According to an aspect of the disclosure, there is provided an image forming apparatus including an apparatus body; a fixing unit that is provided in the apparatus body, and heats and fixes a toner image transferred to a recording medium; and a transport path after fixing that transports the recording medium after heating and fixing by the fixing unit. The image forming apparatus incudes a first duct that includes a transport path forming member which forms one side surface of the transport path after fixing, and is provided with at least one or more first intake ports, and that guides air in the transport path after fixing to an outside of the apparatus body; a first fan that is provided in the first duct, and discharge the air in the first duct to the outside of the apparatus body; a filter that is provided in the first duct, and is disposed on the downstream side from the first intake port; and a separating member that separates the transport path after fixing from a space other than the first duct in the apparatus body.

DESCRIPTION OF THE EMBODIMENTS

First Embodiment

Figure 1:
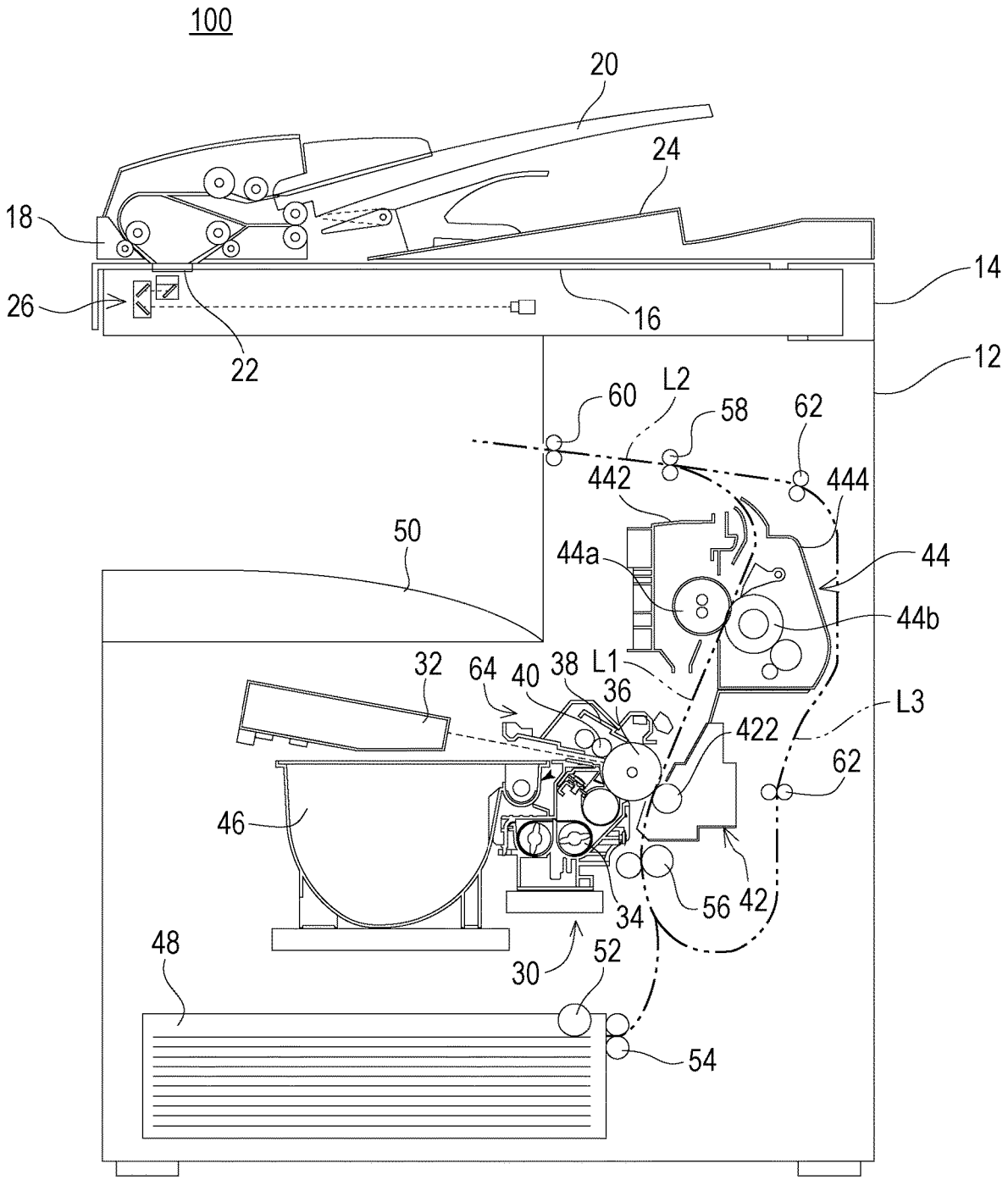
FIG. 1 is a schematic view illustrating a schematic configuration of an image forming apparatus which is a first embodiment of the disclosure in a case of being viewed from a front surface.

FIG. 1 is a schematic view illustrating a schematic configuration of an image forming apparatus 100 which is a first embodiment of the disclosure. The image forming apparatus 100 illustrated in FIG. 1 is a multifunction printer having a copying function, a printer function, a scanner function, and a facsimile function, and forms a monochrome image on a recording medium by electrophotography. The recording medium can be a sheet or an overhead projector sheet, but the following description explains the use of the sheet.

In this specification, out of the horizontal direction in a case where the image forming apparatus 100 is viewed from the front surface, the left side is defined as a left direction and the right side is defined as a right direction. The front surface side of the image forming apparatus 100 is defined as a forward direction (front surface direction) in the backward direction in a case where the image forming apparatus 100 is viewed from above (below), and the rear surface side of the image forming apparatus 100 is defined as a backward direction (rear surface direction).

First, a configuration of the image forming apparatus 100 will be schematically described. As illustrated in FIG. 1, the image forming apparatus 100 includes an apparatus body 12 provided with an image forming unit 30, and an image reading device 14 disposed above the apparatus body.

The image reading device 14 includes a document placing table 16 formed of a transparent material. Above the document placing table 16, a document pressing cover 18 is openably and closably attached via a hinge or the like. A document feeding tray 20 is provided on an upper surface of the document pressing cover 18, and an automatic document feeder (ADF) is provided therein. The ADF automatically feeds the document placed on the document feeding tray 20 one by one to the image reading position 22 and ejects the document to the document discharging tray 24.

The image reading unit 26 incorporated in the image reading device 14 includes a light source, a plurality of mirrors, an imaging lens, and a line sensor. The image reading unit 26 exposes the surface of the document by a light source and guides the reflected light reflected from the surface of the document to the imaging lens by the plurality of mirrors. Then, the reflected light is imaged on the light-receiving element of the line sensor by the imaging lens. In the line sensor, brightness and chromaticity of the reflected light formed on the light-receiving element are detected, and image data based on the image of the surface of the document is generated. As a line sensor, a charge coupled device (CCD), a contact image sensor (CIS), or the like can be used.

On the front surface side of the image reading device 14, there is provided an operation panel (not shown) for receiving an input operation such as a print instruction by a user. The operation panel has a display with a touch panel and a plurality of operation buttons.

In addition, a control unit (not shown) including a CPU, a memory, and the like is provided in the apparatus body 12. The control unit transmits control signals to various parts of the image forming apparatus 100 and performs various operations on the image forming apparatus 100 in accordance with an input operation to the operation panel and the like.

The image forming unit 30 includes an exposure unit (optical scanning unit) 32, a developing unit 34, a photosensitive drum 36, a cleaner unit (cleaning unit) 38, a charging unit 40, a transfer unit 42, a fixing unit 44, and a toner supply device 46, and forms an image on a sheet transported from the sheet feeding cassette 48 or the like, and the ejects the sheet on which the image formed to a sheet ejecting tray 50. As image data for forming an image on the sheet, image data read by the image reading unit 26 or image data transmitted from an external computer or the like is used.

The photosensitive drum 36 is an image holding member having a photosensitive layer formed on the surface of a conductive cylindrical base and is configured to be rotated about axis by a rotary driving source (not shown) such as a motor. The charging unit 40 charges the surface of the photosensitive drum 36 to a predetermined potential. The exposure unit 32 is configured as a laser scanning unit (LSU) including a laser emitting unit and a reflecting mirror, and exposes the surface of the charged photosensitive drum 36 to form an electrostatic latent image corresponding to image data on the surface of the photosensitive drum 36. The developing unit 34 includes a developer tank (developing housing) for containing toner, supplies toner to the surface of the photosensitive drum 36, visualizes the electrostatic latent image formed on the surface of the photosensitive drum 36 with toner (a toner image is formed). A toner concentration detection sensor for detecting the toner concentration is provided in the developer tank. When the toner concentration detected by this toner concentration detection sensor becomes lower than a predetermined value, toner is supplied from the toner supply device 46 to the developer tank. The cleaner unit 38 includes a cleaning blade that abuts against the surface of the photosensitive drum 36, and removes toner remaining on the surface of the photosensitive drum 36 after development and image transfer. However, in the image forming apparatus 100 of the first embodiment, the photosensitive drum 36, the charging unit 40, and the cleaner unit 38 are further unitized, and are detachably provided as a process unit 64 including these units in the apparatus body 12.

The transfer unit 42 is a unit for transferring a toner image formed on the surface of the photosensitive drum 36 onto a sheet, and includes a transfer roller 422 provided so as to press the photosensitive drum 36. When an image is formed, a predetermined voltage is applied to the transfer roller 422, and thereby a transfer electric field is formed between the photosensitive drum 36 and the transfer roller 422. With this action of the transfer electric field, while the sheet passes through a transfer nip portion between the photosensitive drum 36 and the transfer roller 422, the toner image formed on the outer peripheral surface of the photosensitive drum 36 is transferred onto the sheet.

The fixing unit 44 includes a heat roller (fixing roller) 44*a* and a pressure roller 44*b*, and is disposed above the transfer unit 42 (the downstream side in the sheet transport direction). Further, the heat roller 44*a* is disposed on the sheet ejecting tray 50 side (left side) with respect to the pressure roller 44*b*. Further, the heat roller 44*a* is supported by a first support member 442, and the pressure roller 44*b* is supported by a second support member 444. The first support member 442 and the second support member 444 constitute a transport path of a sheet passing through a fixing nip portion between the heat roller 44*a* and the pressure roller 44*b* (a part of a first sheet transport path L1 and a part of a second sheet transport path L2). Further, the first support member 442 is configured to surround three sides of the upper surface (top surface), the left side surface (one side surface), and the lower surface (bottom surface) of the heat roller 44*a*. The second support member 444 is configured to surround three sides of an upper surface (top surface), a right side surface, and a lower surface (bottom surface) of the pressure roller 44*b*.

The heat roller 44*a* is set to be at a predetermined fixing temperature (for example, 160° C.), and when the sheet passes through the fixing nip portion between the heat roller 44*a* and the pressure roller 44*b*, the toner image transferred to the sheet is melted, mixed, and pressed, and thus is thermally fixed (heated and fixed) on the sheet.

In such an apparatus body 12, the first sheet transport path L1, the second sheet transport path (corresponding to the transport path after fixings L2, and a third sheet transport path L3, through which a sheet is transported, are formed. The first sheet transport path L1 is provided to send the sheet transported from the sheet feeding cassette 48 and the like to the register roller 56, the transfer unit 42, and the fixing unit 44. The second sheet transport path L2 is provided to send the sheet after thermal fixing by the fixing unit 44 to the sheet ejecting tray 50, following the first sheet transport path L1. The third sheet transport path L3 is a path for transporting the sheet after single-sided printing and passing through the fixing unit 44, from the second sheet transport path L2 to the first sheet transport path L1 on the upstream side in the sheet transport direction of the transfer roller 422 (the transfer nip portion). Here, the image forming apparatus 100 of the first embodiment is a so-called vertical transport type image forming apparatus. Therefore, in the first sheet transport path L1 and the second sheet transport path L2, the sheet is transported from the lower side to the upper side. On the other hand, in the third sheet transport path L3, the sheet is transported from the upper side to the lower side. Hereinafter, the term "sheet transport direction" simply means the sheet transport direction (direction from the lower side to the upper side) in the first sheet transport path L1 and the second sheet transport path L2.

The sheet feeding cassette 48 is provided with the sheet feeding tray for storing sheets, a pick-up roller 52 for picking up sheets stored in the sheet feeding tray one by one and supplying them to the first sheet transport path L1, and a separation roller 54. The second sheet transport path L2 is provided with a transport roller 58 for imparting a propelling force no the sheet, and an ejecting roller 60 for ejecting the sheet to the sheet ejecting tray 50. Further, on the third sheet transport path L3, a transport roller 62 for applying the propelling force to the sheet is appropriately provided.

When single-sided printing is performed in the apparatus body 12, the sheet is guided one by one from the sheet feeding cassette 48 to the first sheet transport path L1 and transported to the register roller 56. Then, the register roller 56 transports the sheet to the transfer nip portion at a timing when the leading edge of the sheet and the leading edge of image information (toner image) on the photosensitive drum 36 are aligned, and the toner image is transferred onto the sheet. Thereafter, by passing through the fixing unit 44 (fixing nip portion), an unfixed toner on the sheet is thermally fixed. The thermally fixed sheet is transported to the second sheet transport path L2 by the transport roller 58 and the ejecting roller 60, and is ejected to the sheet ejecting tray 50.

On the other hand, at the time of performing dual-sided printing, when the printing on the front side is finished and a trailing end portion of the sheet having passed through the fixing unit 44 reaches the ejecting roller 60, the electing roller 60 and the transport roller 58 are reversely rotated, and thereby the sheet reversely travels and is guided from the second sheet transport path L2 to the third sheet transport path L3. The sheet guided to the third sheet transport path L3 is transported to the third sheet transport path L3 by the transport roller 62 and guided to the first sheet transport path L1 of the register roller 56. Since the front and back of the sheet are reversed at this point, thereafter, the sheet passes through the transfer nip portion and the fixing nip portion, and thereby the printing is performed on the rear surface side of the sheet.

In the image forming apparatus 100 as described above, a manual sheet feeding tray is provided, or an external sheet feeding unit is mounted in some cases. In such a case, in place of the sheet feeding cassette 48, a sheet may be fed from the manual sheet feeding tray or the sheet feeding unit to the first sheet transport path L1.

Figure 2:
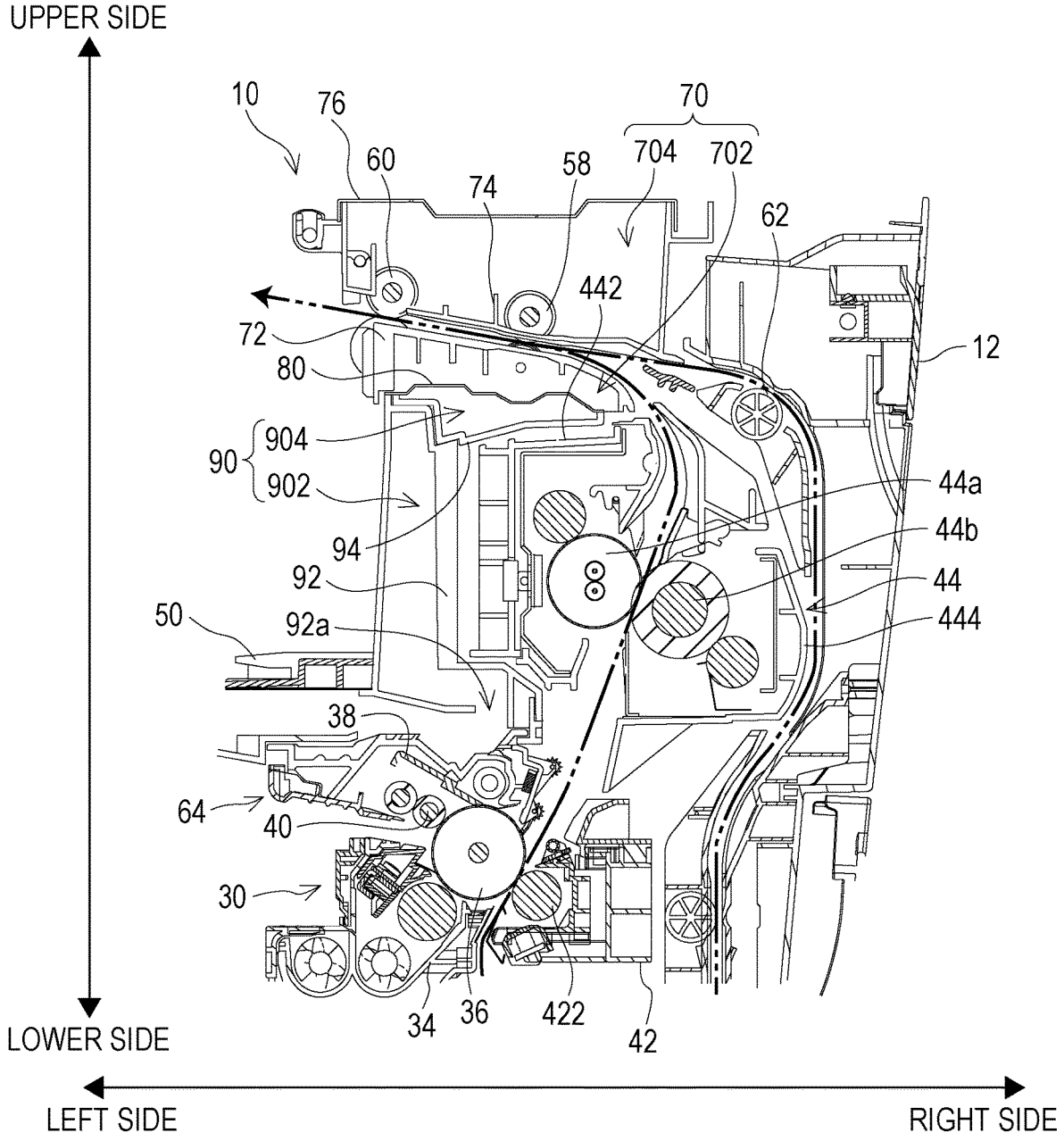
FIG. 2 is a schematic sectional view illustrating a structure of an exhaust unit provided in the image forming apparatus illustrated in FIG. 1.
Figure 3:
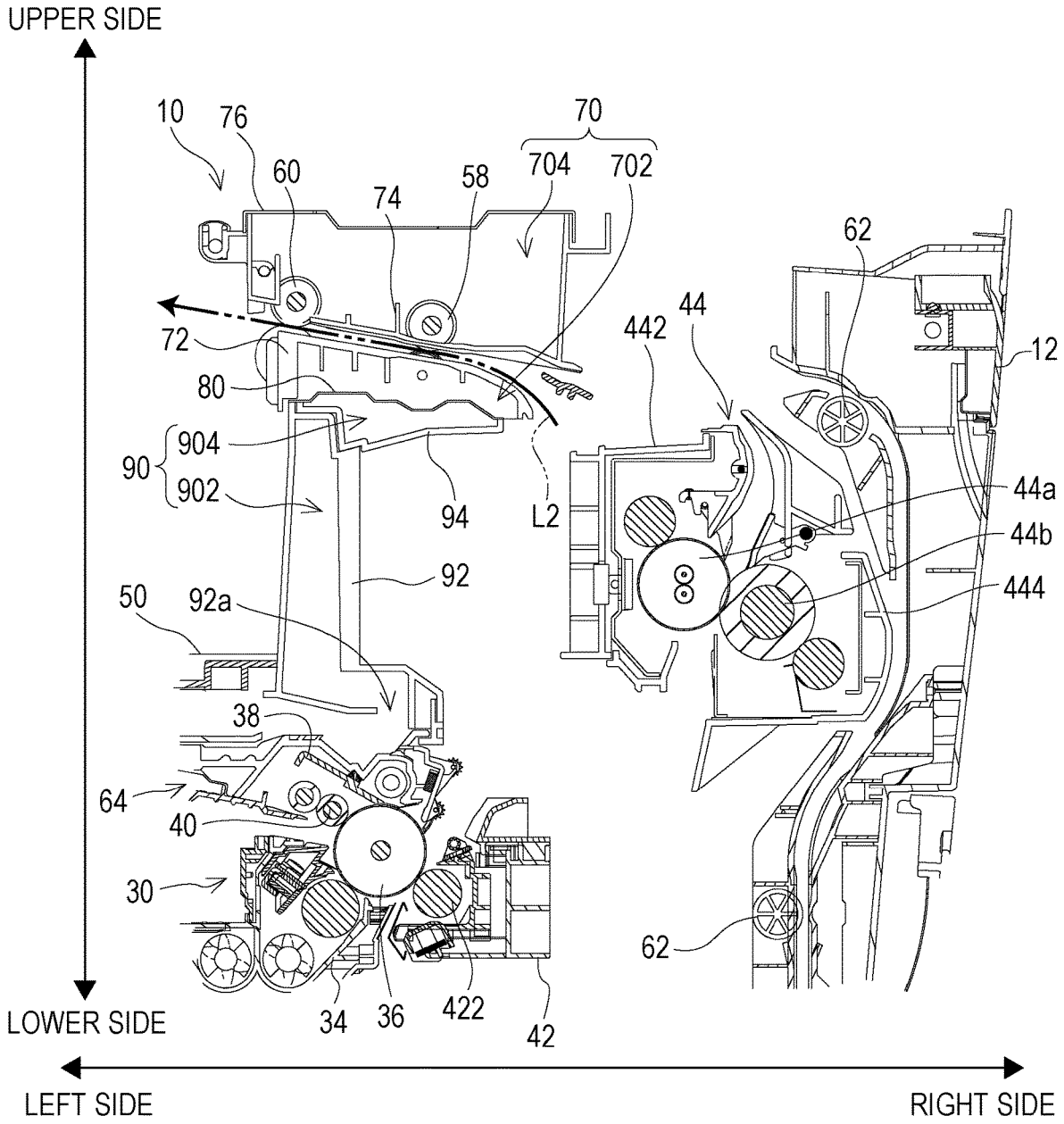
FIG. 3 is a schematic sectional view illustrating the structure of the exhaust unit in a state where a fixing unit is separated.
Figure 4:
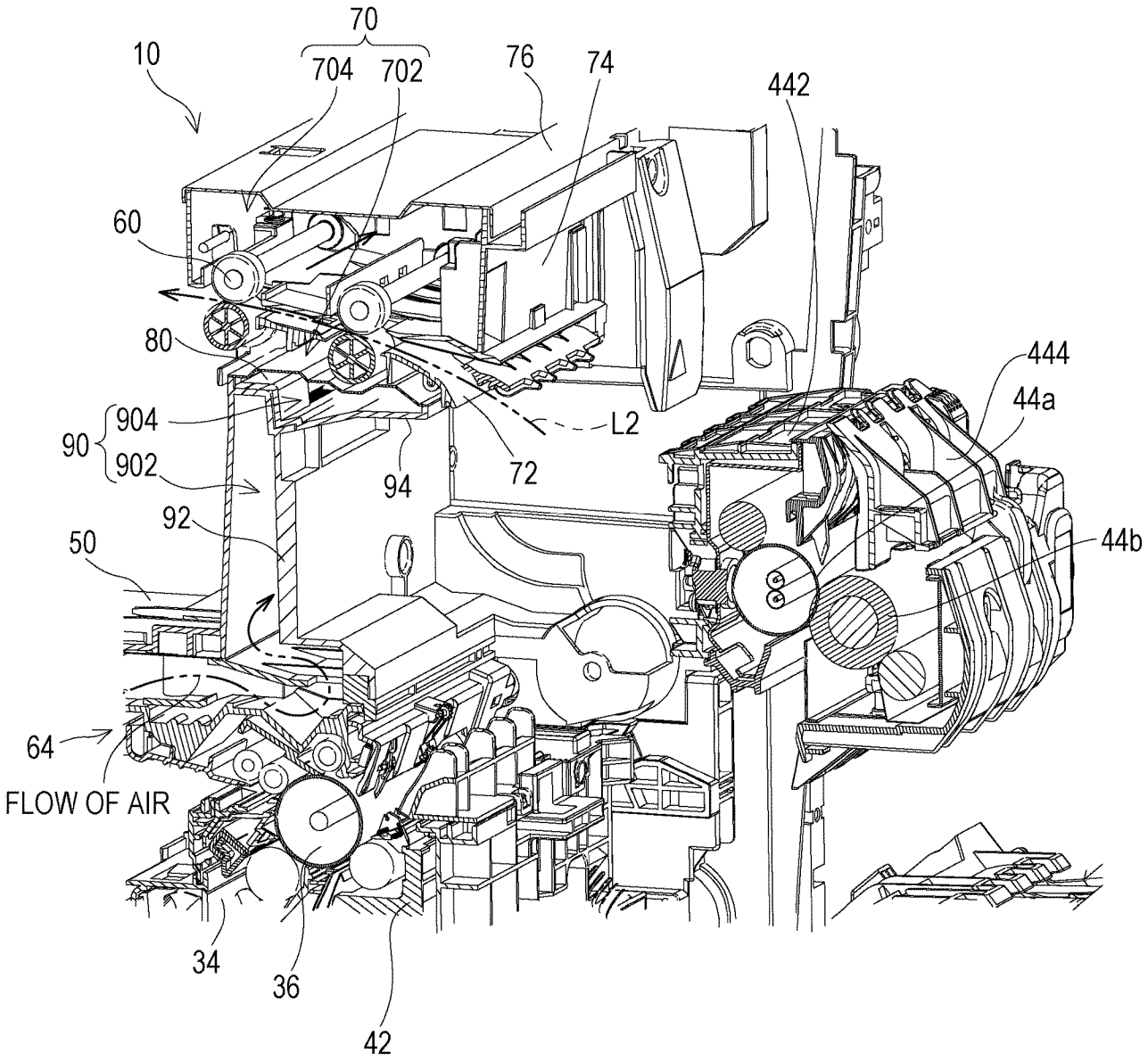
FIG. 4 is a schematic sectional view of the exhaust unit in the state where the fixing unit is separated when viewed from an upper portion of the front surface.
Figure 5:
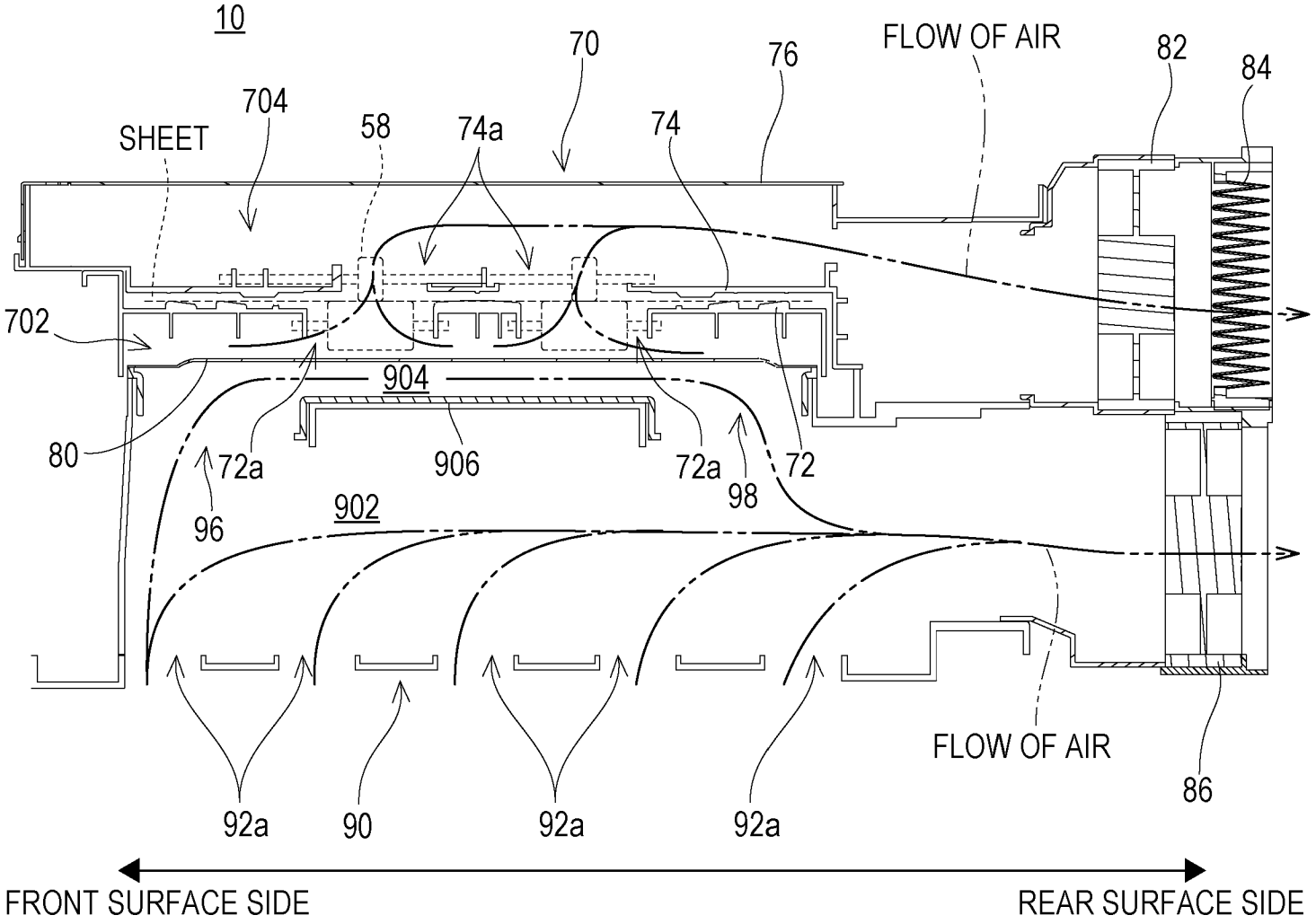
FIG. 5 is a schematic sectional view illustrating a flow of the air in first and second ducts.
Figure 6:
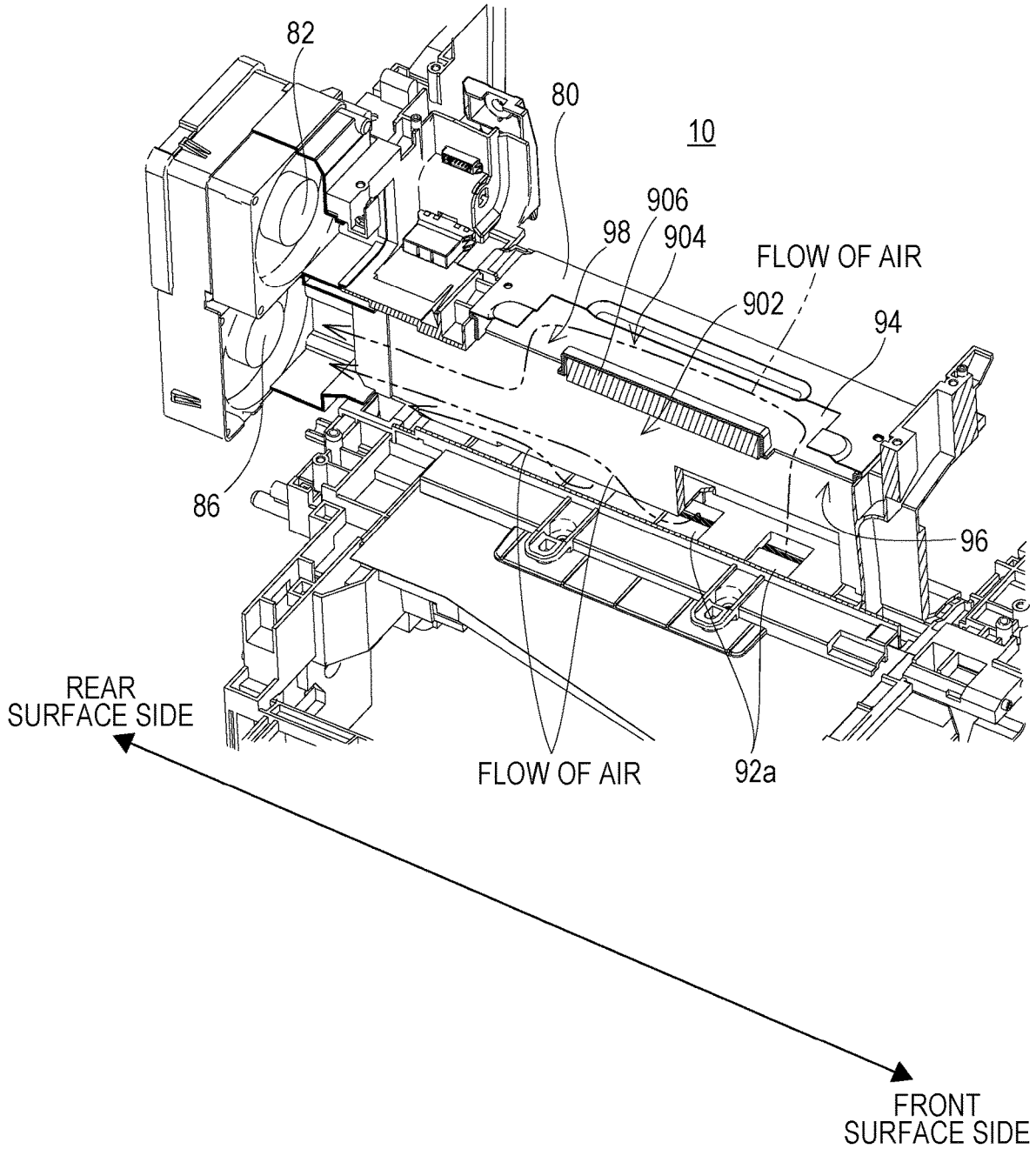
FIG. 6 is a schematic sectional view illustrating the flow of the air in the second duct.

Further, the image forming apparatus 100 of the first embodiment includes an exhaust unit (exhaust device) 10 that charges the air in the apparatus body 12 to the outside of the apparatus body 12. Hereinafter, the structure of the exhaust unit 10 will be described with reference to the drawings. FIG. 2 is a schematic sectional view illustrating a structure of the exhaust unit 10 provided in the image forming apparatus 100 illustrated in FIG. 1. FIG. 3 is a schematic sectional view illustrating the structure of the exhaust unit 10 in a state where the fixing unit 44 is separated. FIG. 4 is a schematic sectional view of the exhaust unit 10 in the state where the fixing unit 44 is separated when viewed from an upper portion of the front surface. FIG. 5 is a schematic sectional view illustrating a flow of the air in the first duct 70 and the second duct 90. FIG. 6 is a schematic illustrating the flow of the air in the second duct 90.

As illustrated in FIG. 2 to FIG. 4, the exhaust unit 10 includes the first duct 70 and the second duct 90. Each of the first duct 70 and the second duct 90 are ducts for guiding the air inside the apparatus body 12 to the outside of the apparatus body 12, are formed in a substantially cylindrical shape extending in the front-rear direction, and are arranged in parallel with each other. Each of the first duct 70 and the second duct 90 is connected to an exhaust port (not shown) on the rear surface side of the apparatus body 12, and communicates with the outside of the apparatus body 12 via the exhaust port of the apparatus body 12. Further, although the details will be described later, the exhaust direction of the first duct 70 and the second duct 90 is set on the rear surface side. Therefore, in the first duct 70 and the second duct 90, the front surface side is the upstream side of the flow of the air (air flow) and the rear surface side is the downstream side of the air flow.

First, a configuration of a first duct 70 will be described. The first duct 70 is disposed on the fixing unit 44. Specifically, the first duct 70 is disposed on the first support member 442 supporting the heat roller 44*a* and the heat roller 44*a*.

The first duct 70 includes a first duct A portion 702 constituting the lower side of the first duct 70, a first duct B portion 704 constituting the upper side of the first duct 70, and the second sheet transport path L2 (sheet transport space after heat fixing) formed to be sandwiched between the first duct A portion 702 and the first duct B portion 704.

The first duct A portion 702 is partitioned by a first duct A forming member (transport path forming member) 72 and a separating member 80. The first duct A forming member 72 has a U-shaped cross section opened downward and is a member extending in the front-rear direction. The separating member 80 is a plate-like member extending in a substantially horizontal direction of the front and rear, and seals the lower side of the first duct forming member 72. That is, the bottom surface of the first duct 70 is sealed by the separating member 80. In addition, the separating member 80 is bent and has projections and depressions formed therein.

The first duct B portion 704 is partitioned by a first duct B forming member (transport path forming member) 74 and a first duct B wall member 76. The first duct B forming member 74 is disposed above the first duct A forming member 72 with a predetermined space therebetween and has a U-shaped cross section opened upward and is a member extending in the front-rear direction. The first duct B wall member 76 is a plate-like member extending in a substantially horizontal direction of the front and rear, and seals the upper side of the first duct B forming member 74. That is, the top surface of the first, duct 70 is sealed by the first duct B wall member 76.

Further, the above-described second sheet transport path L2 is configured to traverse the first duct 70 in the left and right direction. Specifically, the second sheet transport path L2 at the portion crossing the first duct 70 is formed of the to surface (top wall) of the first duct A forming member 72 and the bottom surface (bottom wall) of the first duct B forming member 74 disposed above the first duct A forming member 72. It canal be said that the separating member 80 that partitions the bottom surface of the first duct 70 (the bottom surface of the first duct A portion 702) is provided between the second sheet transport path L2 and the fixing unit 44.

As illustrated in FIG. 2, an entrance of the second sheet transport path L2 (opening on the upstream side in the sheet transport direction) constituted by the first duct 70 is provided immediately after an exit of the first sheet transport path L1 (sheet discharge port of the fixing unit 44) constituted by the fixing unit 44. That is, the second sheet transport path. L2 is in a state in which the portion constituted by the fixing unit 44 and the portion constituted by the first duct 70 are connected to each other.

As illustrated in FIG. 5, a plurality of communication ports 72*a* are formed on the top wall of the first duct A forming member 72, and a plurality of communication ports (first intake port) 74*a* are formed on the bottom wall of the first duct B forming member 74. Each the plurality of communication ports 72*a* and each of the plurality of communication ports 74*a* are formed to line up in the front-rear direction along the air flow of the first duct 70.

The first duct A portion 702 and the second sheet transport path L2 are communicated with each other by the plurality of communication ports 72*a*, and the first duct B portion 704 and the second sheet transport path L2 are communicated with each other by the plurality of communication ports 74*a*. That is, the first duct A portion 702, the second sheet transport path L2, and the first duct B portion 704 communicate with each other by the plurality of communication ports 72*a* and the plurality of communication ports 74*a*, and a series of spaces (ventilation path) is formed in the first duct 70.

For example, the plurality of communication ports 72*a* and the plurality of communication ports 74*a* are formed in a roller portion of the transport roller 58. Although not illustrated in FIG. 5, the communication port 72*a* and the communication port 74*a* are formed with a predetermined number, a predetermined interval, and a predetermined size over the front-rear direction (width direction of the sheet) of the second sheet transport path L2 such that the air in the first duct A portion 702 can efficiently pass through the first duct B portion 704.

However, as described above, the to surface and the bottom surface of the first duct 70 are sealed by the first duct B wall member 76 and the separating member 80. Therefore, the first duct 70 communicates with the internal space of the apparatus body 12 other than the first duct 70 only at the entrance and the exit (the opening on the downstream side in the sheet transport direction) of the second sheet transport path L2. That is, the second sheet transport path L2 is separated from the internal space of the apparatus body 12 other than the first duct 70 except for the entrance and the exit thereof by the first duct 70.

Further, the separating member 80 is made of a material having high thermal conductivity. For example, the separating member 80 is formed of metallic materials. As the metallic material constituting the separating member 80, a cold rolled steel plate such as aluminum, an aluminum alloy, or SPCC, an electrogalvanized steel sheet such as SECC, a hot-dip galvanized steel sheet such as SPCC, and stainless steel such as SUS can be used.

Next, a configuration of the second duct 90 will be described. As illustrated in FIGS. 2 to 4, the second duct 90 is provided along a portion of the side surface (left side surface) of the to surface, and the bottom surface of the fixing unit 44 of the sheet ejecting tray 50. That is, the second duct 90 is provided so as to surround three sides of the fixing unit 44. Specifically, the second duct 90 is provided along a portion of the left side surface, the top surface, and the bottom, surface of the heat roller 44*a* and the first support member 442 that supports the heat roller 44*a*.

The second duct 90 includes a second duct A portion 902 that covers the left side surface and the bottom surface of the fixing unit 44 (the first support member 442) and a second duct B portion 904 that covers the top surface of the fixing unit 44 (the first support member 442).

The second duct A portion 902 is partitioned by a second duct A forming member 92. The second duct A forming member 92 includes a vertically elongated portion which forms a space extending in the vertical direction along the left side surface of the fixing unit 44 (the first support member 442), a lower end portion which is connected to the lower end of the vertically elongated portion and forms a space extending to the fixing unit 44 side (the first sheet transport path L1 side) along the bottom surface of the fixing unit 44 (first support member 442). A space (ventilation path) having a substantially L-shaped cross section which is partitioned by the vertically elongated portion and the lower end portion of the second duct A forming member 92 is formed in the second duct A portion 902.

Further, a process unit 64 is disposed below the second duct A portion 902 (the lower end portion of the second duct A forming member 92). That is, a portion of the second duct A portion 902 (the lower end portion of the second duct A forming member 92) is provided so as to enter the gap between the fixing unit 44 and the process unit 64.

The second duct B portion 904 is partitioned by the second duct B forming member 94 and the separating member 80. The second duct B forming member 94 is a member which is provided adjacent to the upper side of the second duct A forming member 92, has a U-shaped cross section opened toward the upper side, and extends to in the front-rear direction along the top surface of the fixing unit 44 (the first support member 442). However, in a case of being viewed from the front-rear direction, the second duct B forming member 94 is provided so as to have a flat shape in which the vertical direction is short and the horizontal direction is long, enter the gap between the bottom surface of the first duct 70 and the fixing unit 44, and cover the top surface of the fixing unit 44 (top wall of the first support member 442). Further, the upper side of the second duct B forming member 94 is sealed by the separating member 80. That the top surface of the second duct 90 is sealed by the separating member 80.

As described above, the separating member 80 seals the lower surface of the first duct 70 and seals the top surface of the second duct 90. That is, the first duct 70 and the second duct 90 are provided so as to be adjacent to each other with the separating member 80 interposed therebetween. Also, it can be said that the second duct portion 904 is formed between the first duct 70 and the fixing unit 44.

Here, the lower surface (bottom wall of second duct B portion 904) of the second duct B forming member 94 is formed of the material with heat resistance. To be heat resistant means that the heat resistant temperature exceeds 100 degrees. Further, the lower surface of the second duct B forming member 94 may have the heat resistance equivalent to or more than that of the fixing temperature. For example, as the material constituting the lower surface of the second duct B forming member 94, in addition to a general heat-resistant resin such as polyether sulfone (PIES), polyphenylene sulfide (PPS), liquid crystal polymer (LOP), polyether nitrile (PEN), polyimide (PI), polyamide imide (PAI), polyether ether ketone (PEEK) and polyethylene terephthalate (PET), composite materials formed of these resins and glass fiber, metal, ceramics, and the like can be used. Note that the entirety of the second duct B forming member 94 may be made of a material with heat resistance.

In addition, as illustrated in FIG. 5 and FIG. 6, the first communication port 96 and the second communication port 98 communicating with the second duct A portion 902 and the second duct B portion 904 are formed in second duct 90. Each of the first communication port 96 and the second communication port 98 is formed by a communication hole formed in a portion of the lower surface of the second duct A forming member 92 and a portion of the lower surface of the second duct B forming member 94. The first communication port 96 is positioned on the upstream side (front surface side) of the air flow in the second duct 90. Further, the second communication port 98 is positioned on the downstream side (rear surface side) of the air flow in the second duct 90. The first communication port 96 and the second communication port 98 are formed at positions separated from each other (in the front-rear direction) along the air flow, and a separation wall 906 for separating the second duct A portion 902 and the second duct B portion 904 is formed between the first communication port 96 and the second communication port 98. That is, the second duct 90 is branched into the second duct A portion 902 and the second duct B portion 904 separated from each other on the upstream side of the air flow and the downstream side of the air flow.

Further, as illustrated in FIGS. 2 to 6, a plurality of intake ports (second intake ports) 92*a* through which the air in the internal space of the apparatus body 12 other than the first duct 70 passes are formed in the second duct 90. The plurality of intake ports 92*a* are formed in the bottom wall of the second duct A forming member 92. As illustrated in FIGS. 2 to 4, the plurality of intake ports 92*a* are formed at the end portion on the right side (the fixing unit 44 side or the first sheet transport path L1 side) of the bottom wall of the second duct A forming member 92. That is, the plurality of intake ports 92*a* are formed in a part where the second duct 90 covers the lower side of the fixing unit 44. Further, a plurality of intake ports 92*a* are formed on the upstream side from the fixing unit 44 in the sheet transport direction. That is, the plurality of intake ports 92*a* are formed below the fixing unit 44.

The plurality of intake ports 92*a* are formed in the vicinity of the top surface of the process unit 64 and open toward the process unit 64. Therefore, the plurality of intake ports 92*a* are provided such that the air around the process unit 64 passes through. The lower end portion of the right side wall of the second duct 90 and the top wall of the process unit 64 are disposed without any gap therebetween so that the air in the space on the first sheet transport path L1 side is not suctioned into the plurality of intake ports 92*a*.

As illustrated in FIGS. 5 and 6, the plurality of intake ports 92*a* are arranged at a predetermined interval in the front-rear direction along the air flow of the second duct 90. Here, at least one of the plurality of air intake ports 92*a* is positioned on the upstream side (front surface side) of the air flow from the end portion on the upstream side (front surface side) of the air flow of the separation wall 906.

As described above, the first duct 70 and the second duct 90 are formed. As illustrated in FIG. 5, the first duct 70 is provided with a first exhaust fan (first fan) 82 and a filter 84. The first exhaust fan 82 is disposed at the end portion on the rear surface side (downstream side of the air flow) of the first duct 70, and the filter 84 is disposed on the rear surface side (downstream side of the a r flow) of the first exhaust fan 82. As illustrated in FIGS. 5 and 6, a second exhaust fan (second fan) 86 is provided in the second duct 90. The second exhaust fan 86 is disposed at the end portion on the rear surface side (downstream side of the air flow) of the second duct 90.

The first exhaust fan 82 and the second exhaust fan 86 are axial flow fans, for example, propeller fans. The exhaust direction of the first exhaust fan 82 and the exhaust direction of the second exhaust fan 86 are set on the rear surface side. Therefore, the first exhaust fan 82 suctions the air inside the first duct 70 and sends the suctioned air to the rear surface side (the outside of the apparatus body 12). Further, the second exhaust fan 86 suctions the air inside the second duct 90 and sends the suctioned air to the outside of the apparatus body 12. The first exhaust fan 82 and the second exhaust fan 86 are controlled by the control unit of the image forming apparatus 100 and are operated and stopped in accordance with instructions from the control unit.

The filter 84 is a UFP collection filter for collecting ultrafine particles (UFP). In addition to the UFP collection filter, the filter 84 may include a VOC collection filter for collecting volatile organic compounds (VOC) or ozone.

Next, the flow of the air in the exhaust unit 10 of the first embodiment will be described. First, the flow of the air in the first duct 70 will be described.

As illustrated in FIG. 5, in the first duct 70, when the first exhaust fan 82 is operated, the air in the first duct B portion 704 is suctioned into the first exhaust fan 82. Further, the air in the second sheet transport path L2 passes through the plurality of communication ports 74*a* and is suctioned into the first duct B portion 704. The air in the first duct A portion 702 is suctioned into the first duct B portion 704 through the plurality of communication ports 72*a*, the second sheet transport path L2, and the plurality of communication ports 74*a*. That is, the plurality of communication ports 72*a* also function as the intake ports when the air in the first duct A portion 702 is suctioned into the first duct B portion 704 through the second sheet transport path L2, and the plurality of communication ports 74*a* also function as the intake ports when the in the second sheet transport path 12 and the air in the first duct A portion 702 are suctioned in the first duct B portion 704. Then, the air suctioned into the first exhaust fan 82 from the first duct B portion 704 passes through the filter 84 and is discharged to the outside of the apparatus body 12.

In this way, in the first duct 70, the air in a space (the second sheet transport path L2) to which the sheet is transported and the air in a space (the first duct A portion 702 and the first duct B portion 704) on the upper and lower sides thereof passed through the filter 84 and guided to the outside of the apparatus body 12. That is, the first duct 70 functions as a duct for collecting substances such as UFPs. Here, except for the entrance and exit of the second sheet transport path. L2, the first duct 70 is separated from the internal space of the apparatus body 12 other than the first duct 70, and the entrance of the second sheet transport path L2 that is configured by the first duct 70 is provided immediately after the exit of the first sheet transport path L1 configured by the fixing unit 44. Therefore, it is considered that substances such as UFPs generated at the time of heat fixing are less likely to leak out from the second sheet transport path L2 to other spaces, and almost all of the substances are collected in the first duct 70. In other words, the substances such as UFPs are restrained from entering the internal space of the apparatus body 12 other than the first duct 70, and the generated UFPs are kept within the limited first duct 70, and the substances such as UFPs can be collected without being missed. In addition, the air can be suctioned in a concentrated manner from the first duct 70 including the second sheet transport path L2 through which the sheet after heat fixing is transported, and thus it is possible to efficiently capture the substances such as UFPs.

Next, the flow of the air in the second duct 90 will be described. As illustrated in FIGS. 5 and 6, in the second duct 90, when the second exhaust fan 86 is operated, the air in the second duct A portion 902 is suctioned into the second exhaust fan 86. Then, the air flows into the second duct A portion 902 from the plurality of intake ports 92*a*. At this time, a part of the air flowing into the second duct A portion 902 from the intake port 92*a* positioned on the upstream side (front surface side) of the air flow from the separation wall 906 separating the second duct A portion 902 and the second duct B portion 904 modes upward through the first communication port 96 and flows into the second duct B portion 904, flows through the second duct B portion 904 toward the rear surface side, passes through the second communication port 98, and then flows into the second duct A portion 902 again.

In the image forming apparatus 100 having such a configuration, the heat of the fixing unit 44 is concentrated on the top surface side of the fixing unit 44. In particular, the top surface of the first support member 442 supporting the heat roller 44*a* is heated to a high temperature. In this first embodiment, the second duct B portion 904 is formed between the first duct 70 and the fixing unit 44. The second duct B portion 904 insulates the heat of the fixing unit 44 facing upward, and it is possible to restrain the first duct 70 (the second sheet transport path L2) from being directly exposed to the heat of the fixing unit 44. Therefore, the temperature rise inside the first duct 70 can be suppressed.

Further, in the first embodiment, the second duct 90 is provided with the separation wall 906 for separating the second duct A portion 902 and the second duct B portion 904, so that the air flowing from the intake port 92*a* flows through the second duct B portion 904. Therefore, it is possible to secure the flow rate of the air flowing through the second duct B portion. 904, thereby securing a heat insulating effect on the top surface side of the fixing unit 44.

Furthermore, in the first embodiment, the second duct B forming member 94 (the bottom wall of the second duct B portion 904) facing the top surface of the first support member 442 is formed of a material with heat resistance. Thus, the heat resistance of the second duct B portion 904 can be secured.

Further, if the heat of the fixing unit 44 is transferred to the process unit 64, there is a problem that the temperature of the inside of the process unit 64 becomes higher, the toner between the cleaning blade of the cleaner unit 38 and the photosensitive drum 36 is melted, and thereby a cleaning failure occurs in which toner remains on the surface of the photosensitive drum 36. In the first embodiment, a part of the second duct A portion 902 is formed between the fixing unit 44 and the process unit 64. Therefore, the second duct A portion 902 insulates the heat of the fixing unit 44 facing upward, the process unit 64 can be restrained from being directly exposed to the heat of the fixing unit 44.

Furthermore, since the plurality of intake ports 92*a* are provided such that the air around the process unit 64 passes through, the top surface of the process unit 64 is cooled by the air suctioned into the plurality of intake ports 92*a*. Therefore, it is possible to suppress the temperature rise in the process unit 64 and to restrain the above-described cleaning failure.

Further, the first duct 70 is provided with a high-density filter 84 for collecting the substances such as UFPs. Since a mesh size of the filter 84 is smaller than that of a usual filter, the air flow resistance becomes larger, so that the flow velocity of the air flow passing through the filter 84 is lower than that when a normal filter is installed, and accordingly, the air discharged from the first duct 70 to the outside of the apparatus body 12 is decreased. (Note that, since the mashes are coarse and the UFPs slip through, the usual filter is not suitable to use.)

In the configuration of this example, as described above, the upper and lower sides of the second sheet transport path L2 are constituted by the first duct A portion 702 and the first duct B portion 704, and except for the entrance and the exit, and are partitioned from other spaces and sealed, and thus it is possible to efficiently collect the substances such as UFPs generated from toner and sheet heated by the fixing unit 44 and scattered to the second sheet transport path L2 even at a small flow rate.

However, since the flow rate is lower than when a normal filter is used, there is a problem in that it is not possible to sufficiently cool the second sheet transport path L2 where the heat of the sheet after the heat fixing is transferred to reach a high temperature, and the temperature of the inside of the first duct 70 becomes higher.

On the other hand, since no filter is provided in the second duct 90, the flow rate of the air discharged from the second duct 90 to the outside of the apparatus body 12 can be secured. Here, the first duct 70 and the second duct 90 are provided so as to be adjacent to each other with a separating member 80 formed of a material with high thermal conductivity. That is, the first duct 70 and the second duct 90 are indirectly thermally coupled (thermally coupled) via the separating member 80, and the heat can be mutually transferred between the first duct 70 and the second duct 90. Therefore, by transferring the heat inside the first duct 70 to the air flowing through the second duct 90 via the separating member 80 and discharging the air to the outside of the apparatus body 12, it is possible to suppress the internal temperature of the first duct 70 from becoming higher. That is, the heat of the first duct 70 can be dissipated to the second duct 90 to compensate for lowering a cooling capacity of the first duct 70. In addition, since the separating member 80 has projections and depressions formed, a surface area of the separating member 80 is increased, and the heat radiation effect of the first duct 70 can be enhanced. The separating member 80 may be disposed so as to seal the second duct 90, and the lower part of the first duct 70 may be sealed, for example, by a portion of the second duct B forming member 94. An intake port facing the discharge port side of the fixing unit 44 may be provided in the first duct A portion 702 which is the lower end portion of the first duct 70.

As described above, the second duct 90 has the heat insulating effect of insulating the heat of the fixing unit 44 so as not to be transferred to other components of the image forming apparatus 100, and a cooling effect of suppressing an increase in the internal temperature of the image forming apparatus 100. Here, since the intake port 92*a* of the second duct 90 is formed on the upstream side from the fixing unit 44 in the sheet transport direction, air having a relatively low temperature can be taken in the inside of the second duct 90. Therefore, the above-described heat insulating effect and cooling effect can be efficiently obtained. Further, since the substances such as UFPs are not generated on the upstream side from the fixing unit 44 in the sheet transport direction, the substances such as UFP do not flow into the second duct 90 and are not discharged to the outside of the apparatus body 12.

Second Embodiment

Since an image forming apparatus 100 of a second embodiment is the same as the image forming apparatus 100 of the first embodiment except that it further includes an air blowing unit 110 that sends auxiliary air to the first duct 70, contents different from those of the first embodiment will be described, and redundant explanation will not be made.

Figure 7:
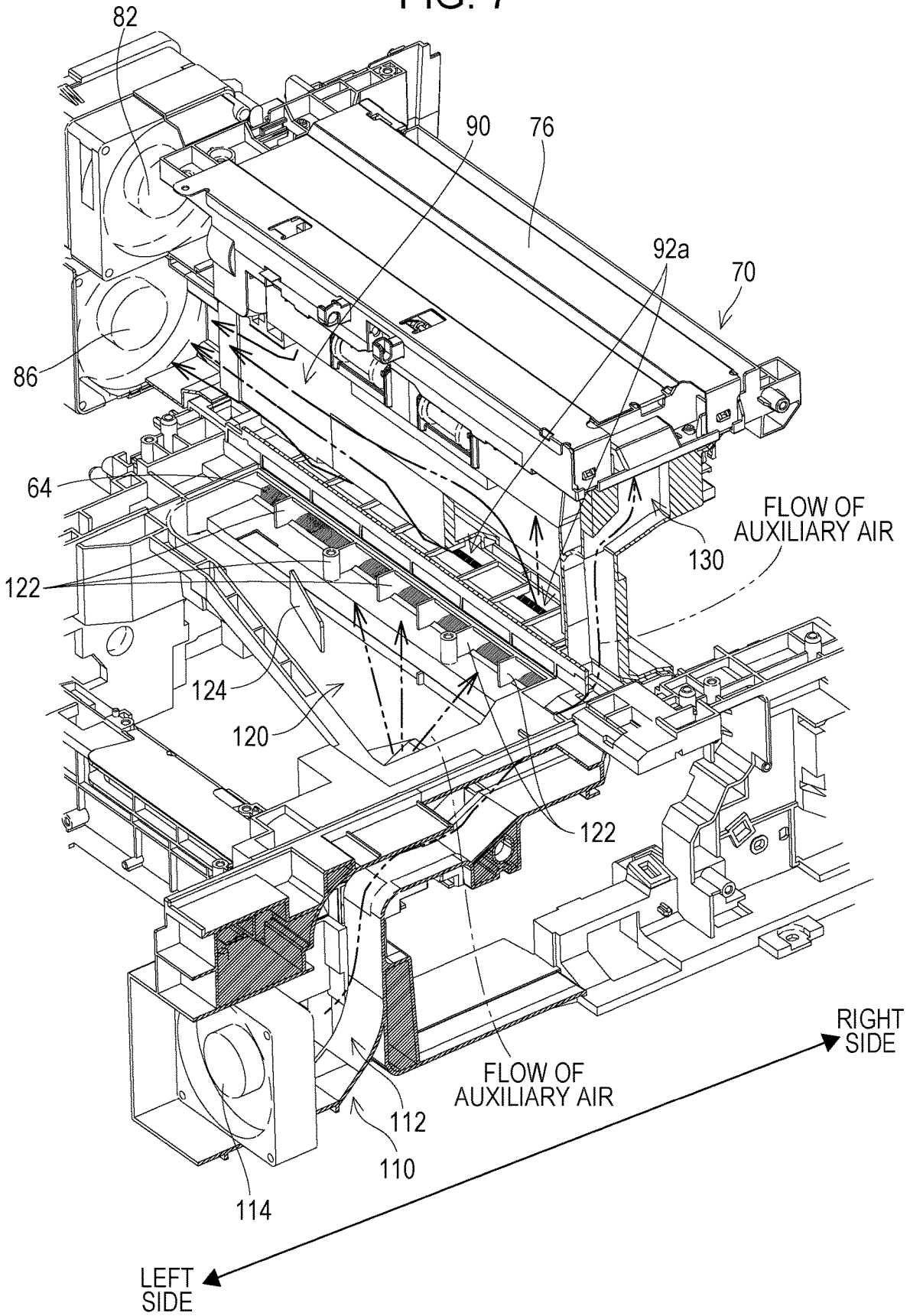
FIG. 7 is a schematic sectional view illustrating structures of an air blowing unit and an exhaust unit of a second embodiment.
Figure 8:
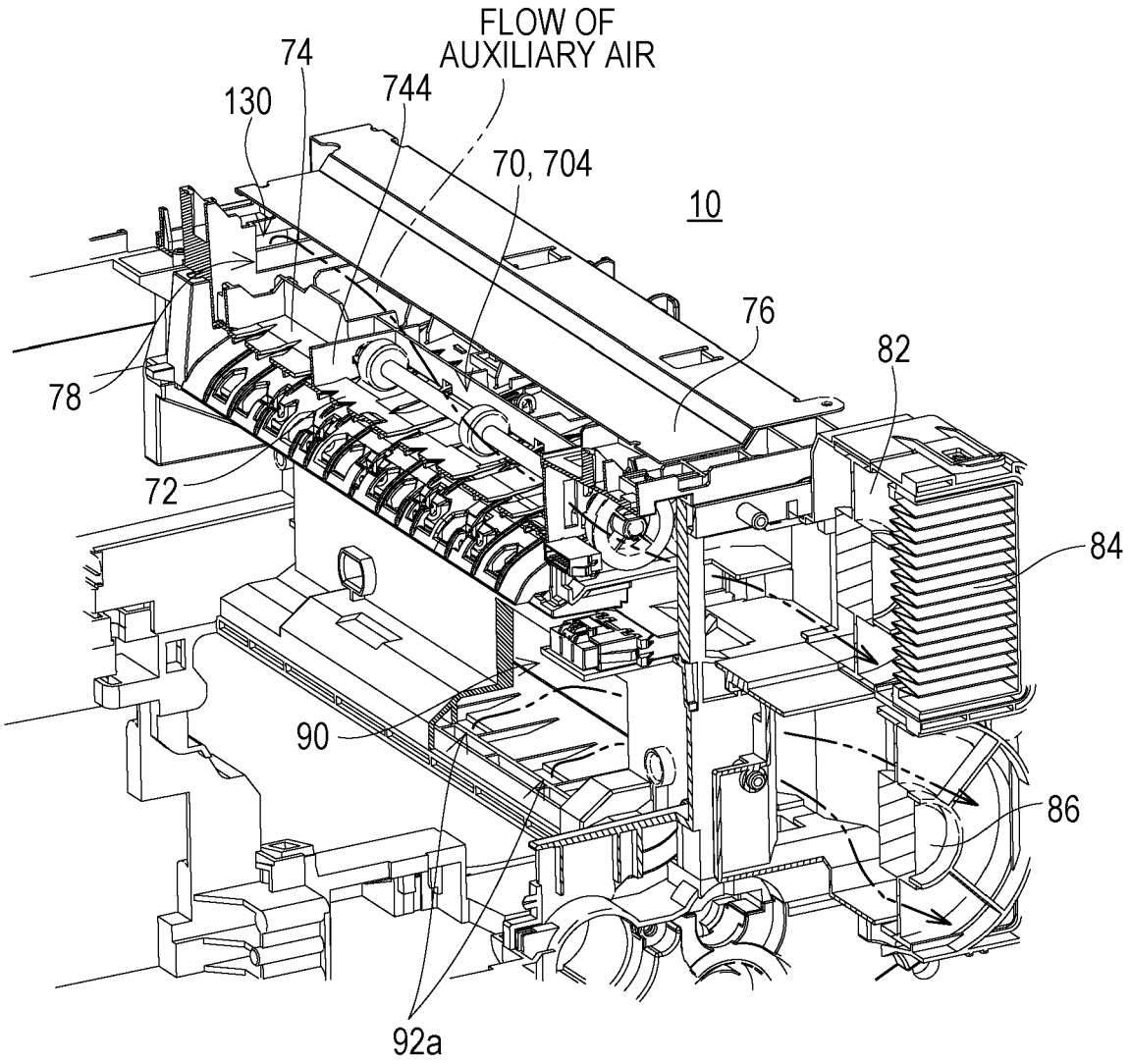
FIG. 8 is a schematic sectional view illustrating a flow of auxiliary air in the first duct of the second embodiment.
Figure 9:
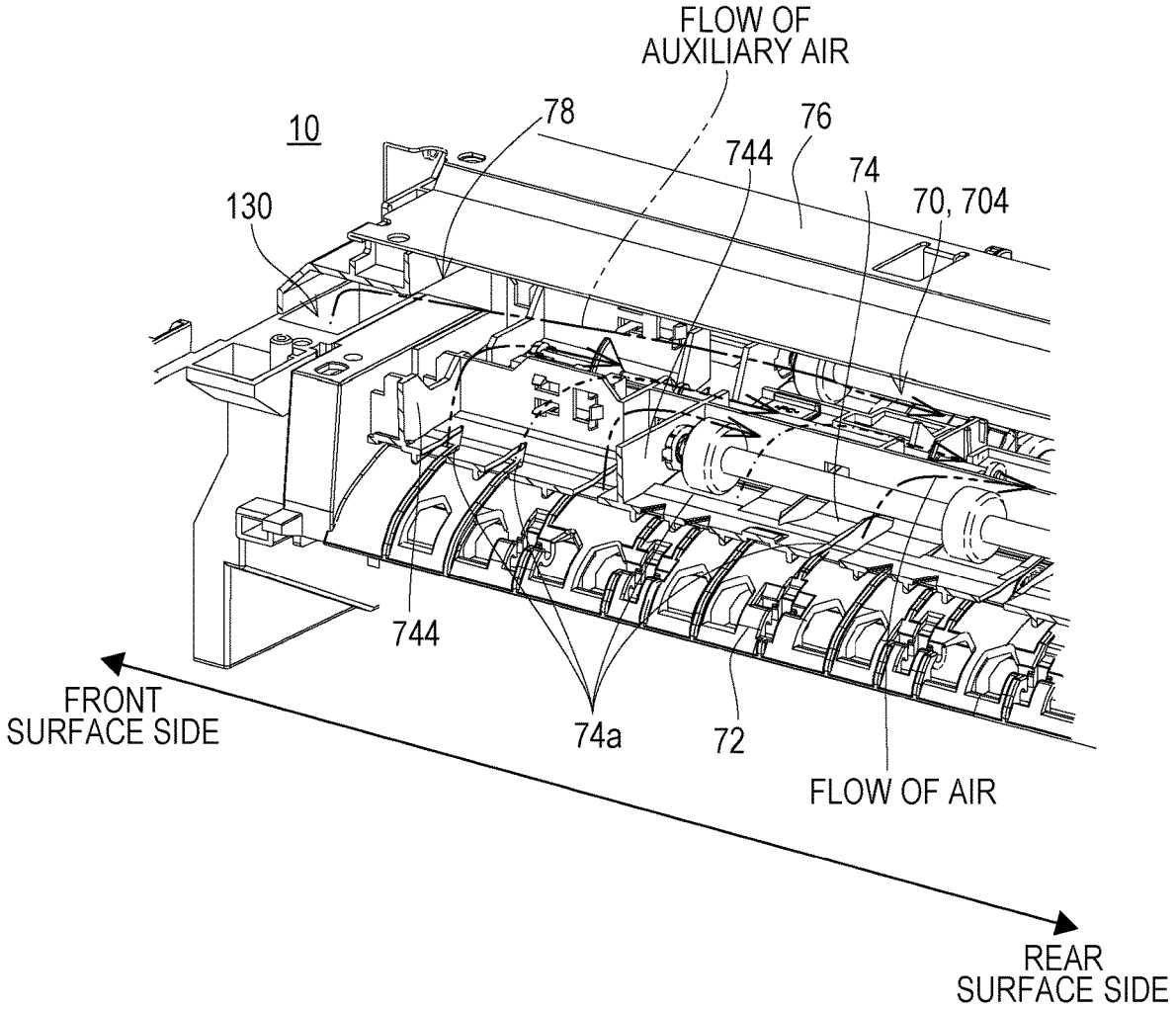
FIG. 9 is a schematic sectional view illustrating the flow of the air in the first duct of the second embodiment.
Figure 10:
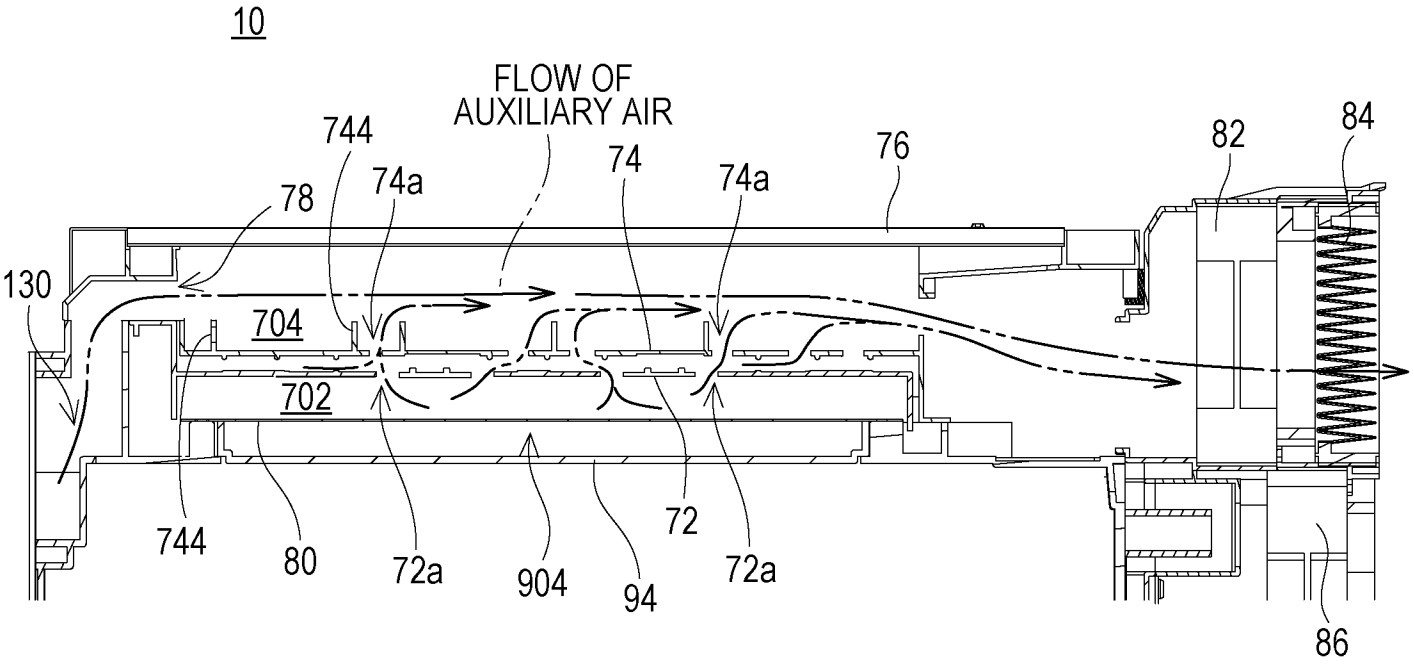
FIG. 10 is a schematic sectional view illustrating the flow of the air in the first duct of the second embodiment.

FIG. 7 is a schematic sectional view illustrating structures of the air blowing unit 110 and the exhaust unit 10 of the second embodiment. FIG. 8 is a schematic sectional view illustrating the flow of air in a first duct 70 of the second embodiment. FIG. 9 is a schematic sectional view illustrating the flow of the air in the first duct 70 of the second embodiment. FIG. 10 is a schematic sectional view illustrating the flow of the air in the first duct 70 of the second embodiment.

As illustrated in FIG. 7, the air blowing unit (air blowing device) 110 includes a third duct 112. The third duct 112 is a duct for guiding air (fresh air) outside the apparatus body 12 to the first duct 70 and the second duct 90. One end portion of the third duct 112 is connected to the intake port (not shown) provided at the front surface side end portion on the left side surface of the apparatus body 12, and communicates with the outside of the apparatus body 12 via the intake port of the apparatus body 12.

A first intake fan (air blowing unit) 114 is provided at one end portion of the third duct 112. The first intake fan 114 is an axial flow fan, for example, a propeller fan. Further, the exhaust direction of the first intake fan 114 is set to the right side. Therefore, the first intake fan 114 suctions the air outside the apparatus body 12 and blows the suctioned air to the inside of the third duct 112. The first intake fan 114 is controlled by the control unit of the image forming apparatus 100 and is operated and stopped in accordance with instructions from the control unit.

Further, the third duct 112 is branched to a third duct A portion 120 and a third duct B portion 130 on the downstream side of the air flow from the first intake fan 114. An end portion of the third duct A portion 120 on the downstream side communicates with the second duct 90, and an end portion of the third duct B portion 130 on the downstream side communicates with the first duct 70. Therefore, the air sent to the inside of the third duct 112 by the first intake fan 114 is sent to the second duct 90 through the third duct A portion 120, and is sent to the first duct 70 through the third duct B portion 130.

The third duct A portion 120 is formed such that inside the apparatus body 12 (below the sheet ejecting tray 50) extends to the right side and the flow path expands toward the rear surface side as going to the right side. The end portion of the third duct A portion 120 on the downstream side enters the lower side of the second duct 90 and communicates with the lower end portion of the second duct 90. Specifically, the third duct A portion 120 communicates with the second duct 90 through a plurality of intake ports 92*a*. Here, the end portion of the third duct A portion 120 on the downstream is formed so as to include all of the intake ports 92*a* of the second duct 90 in the front-rear direction. Therefore, the air (auxiliary air) sent by the first intake fan 114 flows into the second duct 90 from the plurality of intake ports 92*a*.

In addition, the third duct A portion 120 is provided with a plurality of shunt flow rectifying ribs 122 and a shunt rib 124. The plurality of shunt flow rectifying ribs 122 are arranged at the end portion of the third duct A portion 120 on the downstream side, that is, connection portions of the plurality of intake ports 92*a*. Each of the plurality of shunt flow, rectifying ribs 122 is a plate-shaped rib extending in the horizontal direction, and is provided substantially in parallel with a predetermined space therebetween. This shunt flow rectifying rib 122 is provided such that the air flowing through the third duct A portion 120 is rectified so as to secure the flow rate of air flowing into the plurality of intake ports 92*a* and the air sufficiently flows through the intake port 92*a* on the front surface side far from the second exhaust fan 86.

Further, the shunt rib 124 is disposed at a position which is the upstream side from the shunt flow rectifying rib 122 and in which the flow path of the third duct A portion 120 expands. This shunt rib 124 is provided to allow air to flow in a balanced manner to each of the plurality of intake ports 92*a*.

The third duct B portion 130 communicates with the end portion on the front surface side of the first duct 70 by extending the right surface side to the front surface side in the apparatus body 12. As illustrated in FIGS. 8 to 10, an inflow port 78 communicating with the third duct B portion 130 are formed in the first duct 70. Therefore, the auxiliary air sent (supplied) by the first intake fan 114 flows into the first duct 70 from the inflow port 78.

The inflow port 78 is formed on the upstream side (front surface side) of the air flow from the communication port 74*a* formed on the most upstream side of the air flow among the plurality of communication ports 74*a* (FIG. 10). Specifically, the inflow port 76 is formed on the wall (front wall) on the front surface side of the first duct B portion 704. In addition, the inflow port 78 is formed at a position separated in a direction perpendicular to the intake port surface (a bottom wall of a first duct B forming member 74) where the plurality of communication ports 74*a* of the first duct B portion 704 is formed. More specifically, the inflow port 78 is formed at a position apart upward from the bottom wall of the first duct B forming member 74 facing the second sheet transport path L2, in which a plurality of communication ports 74*a* are formed.

A plurality of ribs (partition walls) 744 for narrowing the flow path of the first duct 70 (in this case, the first duct B portion 704) are provided in the bottom wall of the first duct B forming member 74. The rib 744 has a plate shape extending in the vertical and horizontal directions. That is, the rib 744 is formed perpendicular to the air flow of the first duct 70. Here, the height (position of the upper end portion) of the rib 744 is set so as not to block the flow of the auxiliary air (auxiliary air flow). That is, the position of the upper end portion of the rib 744 is set to be equal to or lower than the position of the lower end of the inflow port 78. Therefore, the auxiliary air flow is not obstructed by the rib 744.

Further, the plurality of ribs 744 are arranged along the air flow of the first duct 70 and the auxiliary air flow. At least one of the plurality of ribs 744 is disposed on the upstream side from the communication port 74*a*, among the plurality of communication ports 74*a*, positioned on the most upstream side (the front most side) of the airflow (auxiliary airflow) of the first duct 70. That is, at least one of the plurality of ribs 744 is disposed between the communication port 74*a* positioned on the most upstream side and the inflow port 78.

As described above, the plurality of communication ports 74*a* are arranged along the air flow of the first duct 70. That is, the plurality of communication ports 74*a* are arranged such that distances to the first exhaust fan 82 are different from each other. Therefore, among the plurality of communication ports 74*a*, the communication port 74*a* having a short distance to the first exhaust fan 82 (close to the first exhaust fan 82) and the communication port 74*a* having a long distance to the first exhaust fan 82 (far from the first exhaust fan 82 have different duct resistance (pipe friction loss), and the air flow rate (intake air amount) passing through each of the plurality of communication ports 74*a* becomes ununiform. Particularly, at the communication port 74*a* on the front surface side far from the first exhaust fan 82, the intake air amount from the second sheet transport path L2 is decreased, and the collection efficiency of substances such as UFPs is decreased on the front surface side of the first duct 70.

On the other hand, in the second embodiment, the auxiliary air flowing from the inflow port 78 is made to flow over the plurality of communication ports 74*a* (a region away from the communication port 74*a*). When the flow of the auxiliary air is set in this way, the air suctioned from the communication port 74*a* flows so as to be drawn into (entrained in) the auxiliary air. The faster the flow of the auxiliary air, the more air can be suctioned from the communication port 74*a* (the suction action by the auxiliary air flow). Particularly, since the flow of the auxiliary air in the vicinity of the inflow port 78 is faster than the flow of in other locations of the first duct B portion 704, it is possible to suppress a decrease in the intake air amount in the communication port 74*a* by providing the inflow port 78 on the upstream side from the communication port 74*a* at a position away from the first exhaust fan 82 as described above. That is, it is possible to effectively remove the variation in the intake air amount from the plurality of communication ports 74*a* to make it uniform. Then, the air drawn into the auxiliary air passes through the filter 84 together with the auxiliary air and is discharged to the outside of the apparatus body 2.

In this way, by the auxiliary air flowing from the inflow port 78, the intake air amount of the communication port 74*a* whose the intake amount is decreased due to the pipe resistance can be compensated and the intake air amount from each communication port 74*a* can be made uniform. That is, it is possible to secure the intake air amount of the communication port 74*a* far from the first exhaust fan 82, and to restrain the collection efficiency of the substances such as UFPs from being decreased.

Further, in the second embodiment, the inflow port 78 is formed at a position separated in a direction (upward direction) perpendicular to the bottom wall of the first duct B forming member 74 where the communication port 74*a* is formed. That is, the auxiliary air flow and the respective communication ports 74*a* are vertically separated. Therefore, the effect of increasing the intake air amount from each communication port 74*a* by the auxiliary air flow can be further applied to the downstream. That is, it is possible to make the intake air amount from each communication port 74*a* uniform over a wider range. Further, when the auxiliary airflow and the communication port 74*a* are excessively close to each other, although there is a possibility that the air to be suctioned from the communication port 74*a* flows backward (air flows from the first duct B portion 704 toward the second sheet transport path L2), the auxiliary air flow and each communication port 74*a* are separated from each other, and thus it is possible to restrain such backward flow.

Further, in the second embodiment, the rib 744 for narrowing the flow path of the first duct 70 is provided on the bottom wall of the first duct B forming member 74. This rib (partition wall) 744 can restrain the backward flow of the air to be drawn into the auxiliary air and auxiliary air. At least one of the plurality of ribs 744 is disposed on the upstream side from the communication port 74*a* positioned on the most upstream side of the air flow of the first duct 70, and thus a position away from each communication port 74*a* is set as the flow path of the auxiliary airflow such that the auxiliary airflow and each communication port 74*a* are not close to each other, and thereby it is possible to stably suction the air from each communication port 74*a*. Further, the rib 744 may be provided on the upstream side of the flow of the air in the communication port 74*a*. When the rib 744 is disposed in this way, the downstream side of the rib 744 becomes a negative pressure due to the flow of the auxiliary air passing through the upper portion of the rib 744, and this negative pressure is applied so as to increase the amount of air suctioned from the communication port 74*a*. Therefore, by appropriately providing the rib 744 inside the first duct B portion 704 from the upstream toward the downstream in consideration of the position of the communication port 74*a*, it is possible to make the intake air amount from the plurality of communication ports 74*a* uniform.

In each of the above-described embodiments, the image forming apparatus 100 is configured as a multifunction printer; however, the image forming apparatus of the disclosure may be configured as a printer, a copying machine, or a facsimile machine.

Further, in each of the above-described embodiments, the image forming apparatus 100 is configured as a monochrome compound machine; however, the image forming apparatus of the disclosure may be configured as a color printing machine or a color multifunction printer.

Further, the specific shapes and the like exemplified in the above examples are merely examples, and can be appropriately changed according to actual products.

The present disclosure contains subject matter related to that disclosed in Japanese Priority Patent Application JP 2017-250778 filed in the Japan Patent Office on Dec. 27, 2017, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. An image forming apparatus comprising:

an apparatus body;

a fixing unit that is provided in the apparatus body, and heats and fixes a toner image transferred to a recording medium;

a transport path after fixing that transports the recording medium after heating and fixing by the fixing unit;

a first duct that includes a transport path forming member which forms one side surface of the transport path after fixing, and is provided with at least one or more first intake ports, and that guides air in the transport path after fixing to an outside of the apparatus body;

a first fan that is provided in the first duct, and discharges air in the first duct to the outside of the apparatus body;

a filter that is provided in the first duct, and is disposed on a downstream side in an airflow direction from the at least one or more first intake ports; and a separating member that separates the transport path after fixing from a space other than the first duct in the apparatus body, wherein the first duct includes a first duct A portion and a first duct B portion that are provided so as to sandwich the transport path, the first duct A portion is communicated with the transport path, and the transport path is communicated with the first duct B portion, the first duct A portion is partitioned by a transport path forming member which forms another side surface of the transport path after fixing and the separating member, and the first duct communicates with an internal space of the apparatus body other than the first duct only at an entrance and an exit of the transport path after fixing.

2. The image forming apparatus according to claim 1, wherein the separating member is provided between the transport path after fixing and the fixing unit.

3. The image forming apparatus according to claim 2, further comprising:

a second duct which includes a second intake port through which air from the space other than the first duct passes, and guides the air from the space other than the first duct to the outside of the apparatus body; and a second fan that is provided in the second duct, and discharges the air in the second duct, wherein the separating member constitutes a portion of the second duct.

4. The image forming apparatus according to claim 3, wherein the second duct is provided along at least one side surface and a top surface of the fixing unit.

5. The image forming apparatus according to claim 4, wherein the second duct includes a duct portion which is along the top surface of the fixing unit and is formed between the transport path after fixing and the fixing unit.

6. The image forming apparatus according to claim 5, wherein a bottom wall of the duct portion of the second duct is formed of a material with heat resistance.

7. The image forming apparatus according to claim 1, wherein the separating member is formed of a material with high thermal conductivity.

8. The image forming apparatus according to claim 1, wherein projections and depressions are formed in the separating member.

* * * * *